US005269085A

United States Patent [19]

Chiapetta et al.

[11] Patent Number: 5,269,085

[45] Date of Patent: Dec. 14, 1993

[54] MASCARA REPLACEMENT INDICATOR

[75] Inventors: Pat Chiapetta, Danbury, Conn.; Catherine E. Farley, New York, N.Y.; Bernie Mazzola, Ramsey, N.J.; E. Mark Smith, New York, N.Y.

[73] Assignee: Avon Products, Inc., New York, N.Y.

[21] Appl. No.: 703,688

[22] Filed: May 21, 1991

[51] Int. Cl.[5] ..... B65D 55/02

[52] U.S. Cl. ..... 40/311; 215/230

[58] Field of Search ..... 40/311, 501, 505, 111, 40/112, 107, 486, 334, 335; 206/459; 215/230, 227, 305, 355

[56] References Cited

U.S. PATENT DOCUMENTS

| | | | |
|---|---|---|---|
| 564,885 | 7/1896 | Johnson | 40/335 |
| 652,288 | 6/1900 | Phelps | 40/335 |
| 3,960,713 | 6/1976 | Carey | 206/459.1 |
| 5,082,129 | 1/1992 | Kramer | 215/305 |

*Primary Examiner*—Kenneth J. Dorner
*Assistant Examiner*—C. Hope Davis
*Attorney, Agent, or Firm*—Ohlandt, Greeley & Ruggiero

[57] ABSTRACT

A cosmetic container comprising a hollow body for containing cosmetics therein, a cap adapted to be secured at one end to the body and a band adapted to be mounted onto the cap. The cap has first, second and third cap portions. The first cap portion has a plurality of indicia. The second cap portion is positioned adjacent the first cap portion and has a plurality of embossments with each embossment aligned with a different one of the plurality of indicia. The second cap portion also has a plurality of tabs. The band has first, second and third surface portions. The first surface portion fits about the first cap portion and has a hole through which the indicia can be viewed. The second and third surface portions are sized to fit about the second cap portion. The second surface portion has an inside surface with a plurality of grooves therein. Each groove engages a different one of the plurality of embossments and the inside surface frictionally engages the plurality of tabs when the hole is positioned over one of the indicia.

23 Claims, 3 Drawing Sheets

MASCARA REPLACEMENT INDICATOR

BACKGROUND OF THE INVENTION

1. Field of the Invention

The present invention relates to a container for a cosmetic product and, more particularly, to a mascara container having an indicator that advises the user that the mascara should be replaced.

Most cosmetic compositions contain ingredients which either decompose or create a build-up of bacteria after a period of time. In addition, certain cosmetic products are simply not as effective within a relatively brief period of time once the container is opened and, thus, the cosmetic composition is exposed to air.

For many years, women have used mascara to enhance or change the color of their eyelashes. Mascara, as with many cosmetic products, includes ingredients that will exhibit some or all of the above adverse effects, within a relatively short period of time after exposure to air. Accordingly, there is a need to discard the mascara within that period of time.

Because of the nature of mascara, it is not feasible to provide a clear container that would visually indicate if the mascara is decomposing. Further, a visual indication may not show the build-up of bacteria. Mascara can be purchased at any given day and is relatively low in cost. Therefore, it is not an item that one would normally monitor. There has been, heretofore, a need to provide an easy means to indicate the date of expiration. Further, the effective life of the mascara commences the first time the mascara is exposed to the air so that the expiration or replacement date for the mascara would need to be predicated, at least in part, on the first date the mascara container is opened and the mascara exposed to air.

Prior to the replacement indicator of the present application, there was not been a convenient means for indicating the expiration or replacement date for mascara. Further, there has not been an indicator that is part of the purchased container. Still further, there has not been an indicator that the purchaser can set to indicate a desired replacement date.

SUMMARY OF THE INVENTION

It is a primary object of the present invention to provide a new cosmetic container.

It is another object of the present invention to provide such a container having an indicator thereon.

It is still another object of the present invention to provide such a container having an adjustable indicator which can be set by the user to indicate a desired replacement date.

It is yet another object of the present invention to provide such a container having an adjustable indicator that once set to a desired replacement date cannot be inadvertently disturbed.

It is yet still another object of the present invention to provide such an indicator that is easy to set and is part of the container itself.

It is yet still another object of the present invention to provide such a container that is relatively inexpensive to manufacture.

These and other objects are provided for by a cosmetic container comprising a hollow body for containing cosmetics therein, a cap adapted to be secured at one end to the body and means adapted to be mounted onto the cap. The cap has first, second and third cap portions. The first cap portion has a plurality of indicia. The second cap portion is positioned adjacent the first cap portion and has a plurality of embossments and a plurality of tabs. Each embossment aligns with a different one of the plurality of indicia.

The means has first, second and third circumferential surface portions. The first surface portion fits about the first cap portion and has a hole through which the indicia can be viewed. The second and third surface portions are sized to fit about the second cap portion. The second surface portion has an inside diameter with a plurality of grooves therein. To secure the hole in position over one of the indicia, each groove of the second surface portion engages a different one of the plurality of embossments of the second cap portion and the inside diameter of the second surface portion frictionally engages the plurality of tabs of the second cap portion.

BRIEF DESCRIPTION OF THE DRAWINGS

The foregoing and still other objects and advantages of the present invention will be more apparent from the following detailed explanation of the preferred embodiments of the invention in connection with the accompanying drawings wherein.

DESCRIPTION OF THE PREFERRED EMBODIMENT

Figure 1:
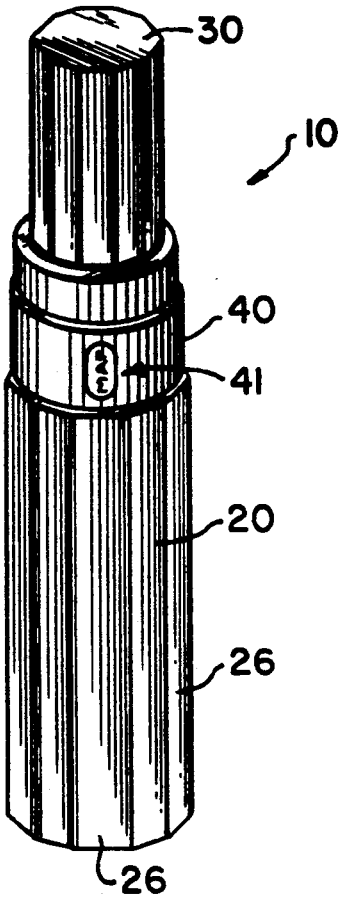
FIG. 1 is a front elevation view of the container of the present application.

Referring to the drawings and, in particular, FIG. 1, there is shown a container for cosmetics generally represented by reference numeral 10. The container 10 includes a body 20 adapted to be removably secured to a cap 30. The container 10 also includes indicator means 40.

Figure 2:
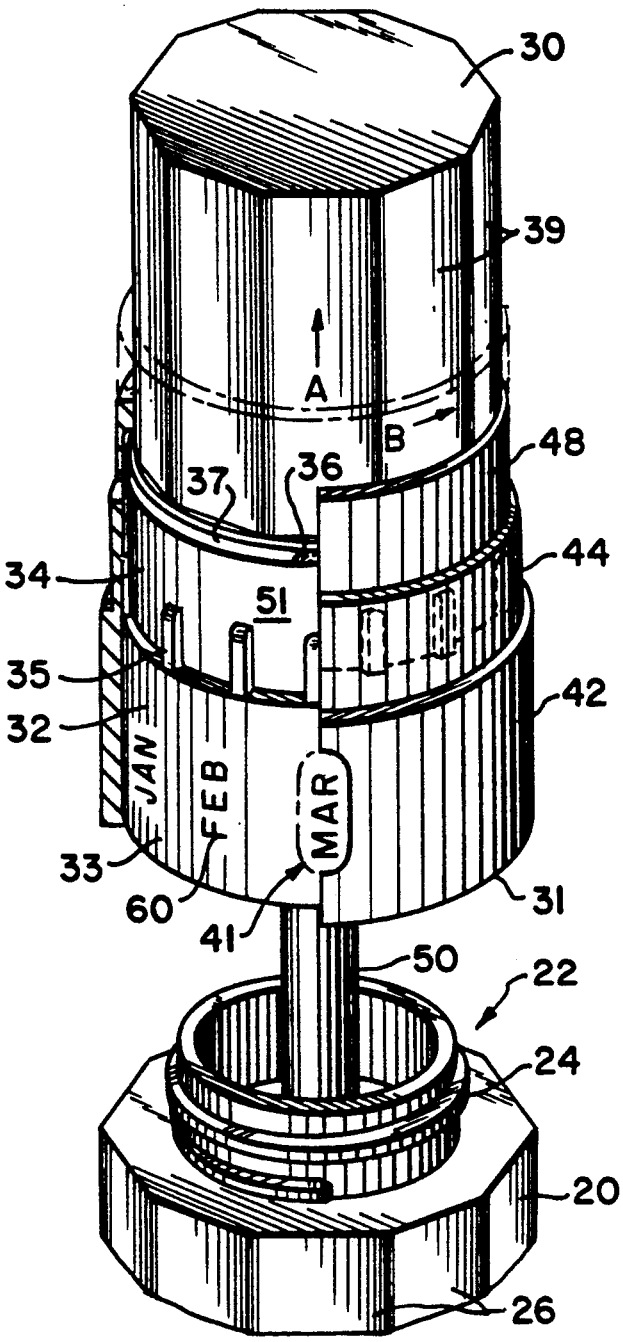
FIG. 2 is an exploded front elevation view of the container of FIG. 1 with the container's indicator partially cut away.

The body 20 is, preferably, elongated, and has a hollow portion that is adapted to retain the cosmetic, such as mascara, therein. As shown in FIG. 2, the body 20 also includes an open end that may have a portion of the securing means 22 thereon.

The securing means 22 is adapted to removably, and tightly, secure the body 20 of the container 10 to the cap 30. The securing means 22, when it connects the body 20 to the cap 30, creates a seal to prevent moisture from entering into the container 10. The securing means 22 can be any conventional means, provided it permits the body 20 and the cap 30 to be disconnected and reconnected at the user's discretion. The preferred securing means 22 includes a male, threaded head 24 on the body 20 that is adapted to engage a female threaded portion (not shown) in the interior surface of cap 30.

Referring to FIGS. 1 and 2, the body 20 may include a plurality of planar surfaces 26. The surfaces 26 provide for an easy grip of the body 20 of the container 10 by the user. The number of planar surfaces 26 can vary, however the number of planar surfaces in the preferred embodiments is between about four to about ten. In the most preferred embodiment, the number of planar surfaces is eight.

The cap 30 has an open end 31 that is adapted to mate with the body 20. As stated above, the cap 30, preferably, has internal threads (not shown) which are adapted to rotatably engage threaded head 24 of the body 20 thereby tightly securing together the body and cap.

Analogous to body 20, the cap 30, preferably, has an elongated shape. In addition, the cap 30, like the body 20, preferably, has an outer surface that includes a plurality of planar surfaces 39. The cap 30 includes a stem 50 that is secured to the inside of the cap. The stem 50 has attached at its free end a conventional applicator for applying cosmetics, such as mascara.

The cap 30 also includes a plurality of circumferential cap portions 32, 34 and 38 along its axial extent. It is preferred that the cap 30 be an integral structure so, therefore, the cap portions would be integrally joined together. However, it is possible that the cap 30 have several sections or areas that are simply connected together.

The first cap portion 32 is located adjacent end 31 and has an outer surface 33 with indicia 60 thereon. The indicia 60 can be any printed indicia. Alternatively, the indicia 60 can be etched or molded into surface 33.

In a preferred embodiment, the indicia 60 is the twelve months of the year, equally spaced apart along the circumference of the first cap portion 32. In a more preferred embodiment shown in FIG. 2, the indicia 60 is the twelve calendar months abbreviated and printed in the axial direction of the container 10. The twelve months of the year have been selected as the time frame for indicating the replacement or expiration date of the mascara. It is within the purview of the present invention, that days or weeks within a month or other analogous criteria can be used as indicia to indicate the replacement date.

As shown in FIGS. 2 through 5, the second cap portion 34 is positioned adjacent the first cap portion 32. The second cap portion 34 includes on its outer surface a plurality of embossments or protuberances 35 and a plurality of tabs 51.

Each embossment 35 is aligned in the axial direction with a different one of the plurality of indicia 60. Accordingly, the number of embossments 35 and indicia 60 should, preferably, be the same. It is preferred that the plurality of embossments 35 be positioned in the lower half of the second cap portion 34, namely along the edge of the second cap portion adjacent the first cap portion 32 as shown in FIG. 2. It is also preferred that the plurality of embossments be in the axial direction and extend less than one-half of the axial extent of the second cap portion 34.

The plurality of tabs 51 are positioned toward the middle to upper part of the second cap portion 34 and form a circumferential row. At least two tabs are needed in order for the tabs to lock the indicator means 40 in its operative position as will be explained below. The tabs should be basically the same in size. The tabs do not need to be equally spaced apart along the circumference of the second cap portion, however it is preferred that they be equally spaced apart. It is believed that any number of tabs greater than two can be used. It is suggested, however, that an even number of tabs be used. In the present preferred embodiments, either two or four tabs are used.

Figure 3:
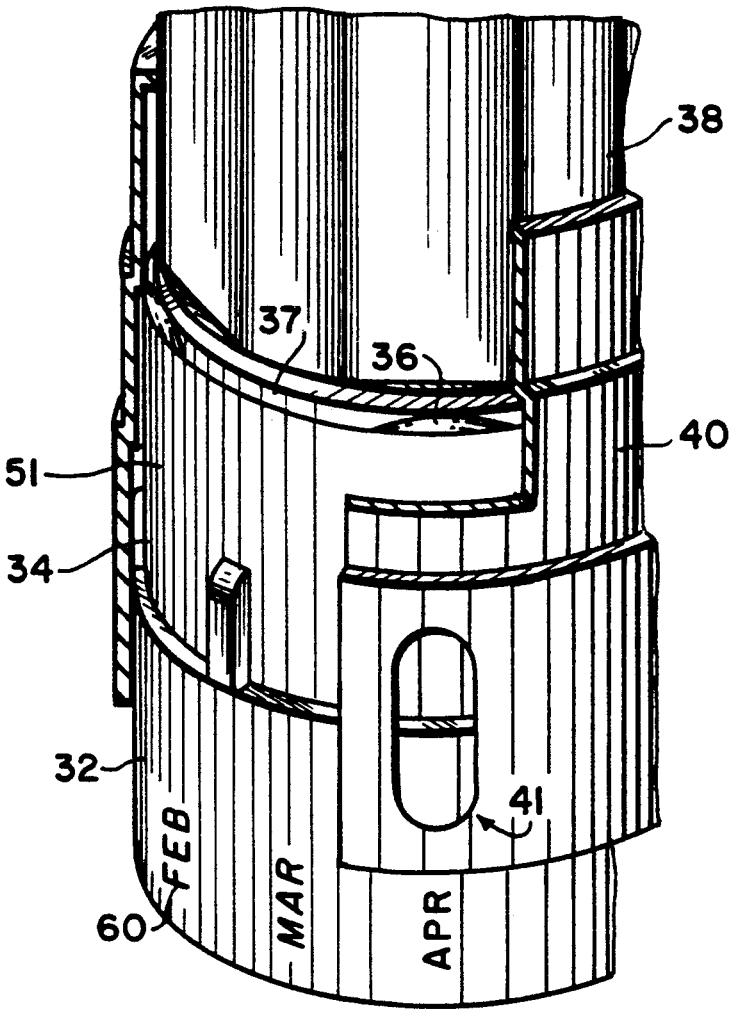
FIG. 3 is an exploded view of a segment of the cap of the container shown in FIG. 2.
Figure 4:
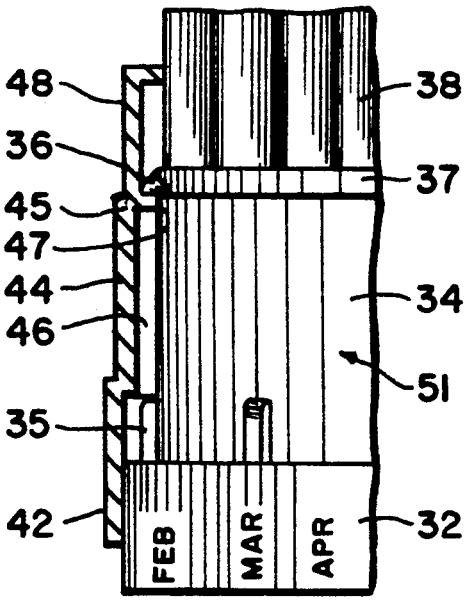
FIG. 4 is a partial cross sectional view of the cap of the container of FIG. 2.

As shown clearly in FIGS. 2 through 4, an edge 37 is located where the second cap portion 34 meets to the third cap portion 38. Preferably, the edge 37 is located on the second cap portion 34. Along edge 37 there is positioned a plurality of edge tabs 36. The edge tabs 36 are, preferably, integrally formed on the edge 37. In a preferred embodiment, the plurality of edge tabs 36 comprise four tabs equally spaced apart along the circumference of the second cap portion 34. The plurality of edge tabs 36 function to prevent the indicator means 40 from detaching from the cap 30. Accordingly, each edge tab 36 extends outward a sufficient distance to engage an edge of the indicator means 40.

Referring to FIGS. 1 through 4, the third cap portion 38 is positioned adjacent the second cap portion 34 and opposite the first cap portion 32. The third cap portion 38, preferably, includes a plurality of planar surfaces 39. These planar surfaces 39, like the planar surfaces 26 in the body 20, permit the user to grip the cap 30. In addition, the plurality of planar surfaces 39 provides an aesthetic appearance.

The number of planar surfaces 39 can vary, however the number of planar surfaces in the preferred embodiments of the present invention are between about eight to about fourteen. In the most preferred embodiment, the number of planar surfaces 39 is twelve.

The container 10 also includes indicator means 40 for viewing the indicia 60. The preferred indicator means 40 is a hollow circular band that has a hole 41 therethrough. The hole 41 can be of any shape that will permit viewing of each indicia. In the preferred embodiment, hole 41 has an oblong shape.

Figure 5:
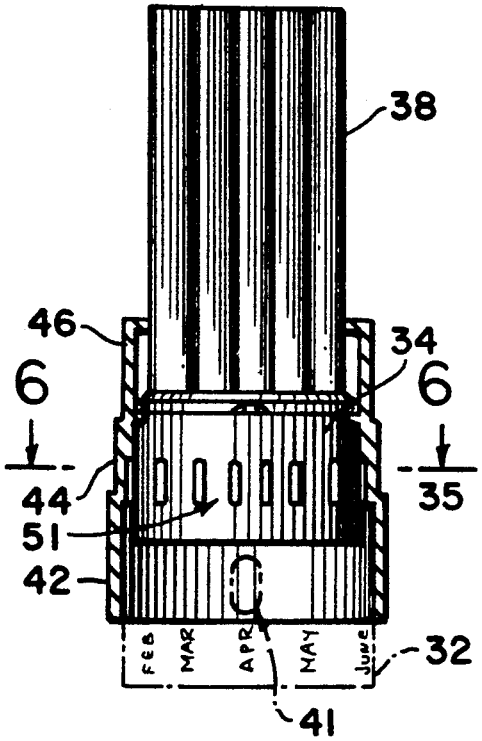
FIG. 5 is an exploded front elevation view of the cap of the container of FIG. 1 again with the container's indicator partial cut away.

The indicator means 40 has an operative position shown in FIGS. 1 and 2 and an inoperative position shown in dotted lines in FIG. 2 and solid lines in FIGS. 3 through 5. In the operative position, the indicator means 40 is positioned so that the hole 41 is held or locked in place about one indicia 60 to permit the indicia to be viewed. The operative position is set by the user to indicate the date when the cosmetic, such as mascara, in the container 10 needs replacement. The replacement date is usually set three months after the end of the month in which the mascara has been purchased.

When the indicator means is in its inoperative position, the indicator means or band 40 is adapted to slide and rotate on the cap 30 as indicated by arrows A and B, respectively, in FIG. 2. The inoperative position, which is the position of the indicator means when the container is sold, permits the user to move the indicator means 40 to align the hole 41 about the desired indicia.

Referring to FIGS. 4 and 5, the indicator means 40 has a plurality of circumferential surface portions 42, 44 and 48. In the operative position, the first circumferential surface portion 42 is sized to fit about the first cap portion 32. The second circumferential surface portion 44 and a portion of the third circumferential surface portion 48 are sized to fit about the second cap portion 34. In this position, the first surface portion 42, that includes the hole 41, is positioned so that the user can view one indicia 60.

The space between the first surface portion 42 and the first cap portion 32, and the space between the second surface portion 44 and the second and third cap portions 34, 38, respectively, is sized so as to permit the indicator means 40 to slide axially on the cap 30 and to rotate on the cap 30 when the indicator means 40 is in its inoperative position. However, the space is relatively small in order to prevent the insertion of any object therebetween.

The second surface portion 44 has an inside diameter or surface 45 with an edge 47. The edge 47 of the inside surface 45 has a diameter that is less than the space between the free end of edge tab 36 and a position opposite that tab on edge 37 of the second cap portion. In the preferred embodiment in which four edge tabs 36 are equally spaced apart about the second cap portion 34, the space between the free ends of the opposite tabs should be slightly greater than the diameter of surface 45. By either construction, the edge 47 of surface 45 engages the plurality of edge tabs 36 of the second cap portion 34 when the indicator means 40 has been slid upwards on the cap 30 to prevent removal of the indicator means 40 from the cap.

The plurality of tabs 51 and the inside surface 45 are sized so that when the indicator means 40 is placed in its operative position, the plurality of tabs 51 of the second cap portion 34 will frictionally engage the edge 47 of the inside surface 45 and thereby assist in locking the indicator means in place. Once it is in its locked or operative position, the indicator means 40 may still be reset by the user, but only with a great deal of force. Thus, the indicator means 40 cannot simply be jarred from its locked or operative position.

Figure 7:
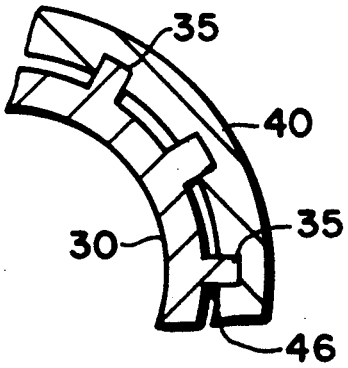
FIG. 7 is an exploded view of a segment of the cross section shown in FIG. 6.

The inside surface 45 of the second surface portion 44 also has a plurality of grooves 46. As shown in FIGS. 4 and 7, each groove 46 is adapted to engage frictionally a different embossment 35 of the second cap portion 34 and thereby also act to lock or secure the hole 41 of the indicator means 40 in its operative position over one indicia 60. It is preferred that the plurality of grooves 46 be positioned along the lower half of the second surface portion, e.g. along the edge of the second surface portion adjacent the first surface portion 42 as shown in FIG. 4. It is also preferred that the plurality of grooves 46 extend in the axial direction and less than one-half of the axial extent of the second surface portion.

Figure 6:
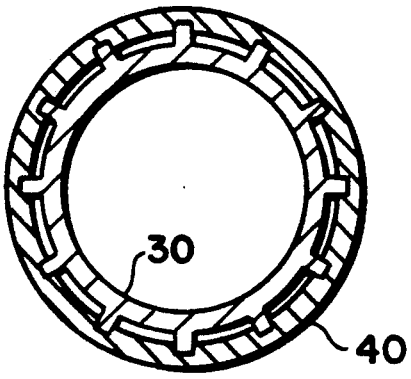
FIG. 6 is a cross sectional view taken along line 6—6 of FIG. 5.

In the operative position, the indicator means 40 cannot turn due to both the engagement of the embossments 35 with the grooves 46 as show in FIGS. 6 and 7 and the frictional engagement of the plurality of tabs 51 with the edge of the inside surface 45 of the second surface portion 44. Also, the sizing of the outside diameter of the three circumferential cap portions of the cap 30 and the inside diameter of the circumferential surface portions of the indicator means 40 provide a limited space that assists in maintaining the indicator means 40 in fixed position on the cap 30. Thus, even if the container 10 is bounced while in a user's purse or the like, the indicator means 40 will not dislodge or turn about cap 30.

In the inoperative position, the edge 47 of the indicator means 40 is positioned between the circumferential row of edge tabs 37 and the circumferential row of tabs 51, and the plurality of embossments 35 remain disengaged from the plurality of grooves 46. In this position, the indicator means 40 can be turned by the user about the cap 30 as shown by arrow B in FIG. 2. Thus, the user can set the indicator means 40, namely hole 41, about any desired indicia by simply sliding the indicator means from the dotted to the solid line positions indicated by arrow A in FIG. 2.

As shown in FIGS. 3 through 5, in the inoperative position, the indicator means 40 is positioned in the axial direction on the cap 30 towards the third surface portion 38 so that first surface portion 42 is positioned about a part of first and second cap portions 32 and 34. Likewise, the second surface portion 44 is about second cap portion 34, while the third surface portion 48 is about a part of both second and third cap portions 34 and 38. As stated above, the plurality of tabs 36 engage edge 45 to prevent the indicator means 40 from being removed from cap 30.

The present invention may, of course, be carried out in other specific ways than those set forth herein without departing from the spirit and essential characteristics of the present invention. The present embodiments are, therefore, to be considered in all respects as illustrative and not restrictive, and to provide for all changes coming within the meaning and equivalency range the appended claims are intended to embrace.

Wherefore we claim:

1. A container for cosmetics comprising:

a hollow body for containing cosmetics therein;

a cap removably secured at one end to the body, the cap having a first, a second and a third cap portion, the first cap portion being positioned adjacent the one end and having a plurality of indicia, the second cap portion being positioned adjacent the first cap portion and having a plurality of embossments with each embossment aligned with a different one of the plurality of indicia, the second cap portion also having a plurality of tabs, the third cap portion being positioned adjacent the second cap portion and opposite the first cap portion;

means, mounted on the cap and adapted to be moved to a desired location, for indicating a desired one of the plurality of indicia to be viewed, the indicating means having a first, a second a da third circumferential surface portion, the first surface portion being sized to fit about the first cap portion and having a hole through which the indicia can be viewed, the second and the third surface portions being sized to fit about the second cap portion the second surface portion having an inside surface with a plurality of grooves therein, wherein each groove is adapted to engage a different one of the plurality of embossments of the second cap portion to prevent rotational movement between the cap and the indicating means when the desired one of the plurality of indicia is selected, and wherein the inside surface is adapted to frictionally engage the plurality of tabs of the second cap portion when the hole is positioned over the desired one of the plurality of indicia to further prevent rotational movement between the cap and the indicating means and thereby maintaining the indicating means in a fixed position on the cap for viewing of the selected desired indicia; and means, positioned on the second surface potion, for preventing removal of the indicating means from the cap.

2. The container of claim 1, wherein the second cap portion has a plurality of edge tabs.

3. The container of claim 2, wherein the preventing means includes the plurality of edge tabs and the inside surface of the second surface portion has an inside edge that is adapted to engage the plurality of edge tabs of the second cap portion to prevent removal of the indicating means from the cap.

4. The container of claim 2, wherein the plurality of edge tabs are integrally formed on the second cap portion.

5. The container of claim 2, wherein the plurality of edge tabs comprise four tabs equally spaced apart along an outer surface portion of the second cap portion.

6. The container of claim 1, wherein the indicating means has an operative position and an inoperative position.

7. The container of claim 6, wherein the indicating means is adapted to slide on and rotate about the cap when the indicating means is in the inoperative position.

8. The container of claim 1, wherein the plurality of indicia is a marking for each moth of a calendar year, and are equally spaced apart along an outer surface portion of the first cap portion.

9. The container of claim 1, wherein the plurality of indicia is an abbreviation for each month of a calendar year abbreviated and is printed in a direction that is an axial direction of the container.

10. The container of claim 1, further comprising securing means for removably connecting together the cap and the body.

11. The container of claim 1, wherein the hole is oblong in shape.

12. The container of claim 1, wherein the plurality of embossments are positioned along an edge of the second cap portion adjacent the first cap portion.

13. The container of claim 12, wherein the plurality of embossments extend in a direction that is an axial direction of the container, and wherein each of the plurality of embossments is less than one-half of an axial extent of the second cap portion.

14. The container of claim 1, wherein the plurality of embossments extend in a direction that is an axial direction of the container, and wherein each of the plurality of embossments is less than one-half of an axial extent of the second cap portion.

15. The container of claim 1, wherein the plurality of tabs are positioned in a part of the second cap portion adjacent to the third cap portion.

16. The container of claim 1, wherein the plurality of tabs are equally spaced apart about an outer surface portion of the second cap portion.

17. The container of claim 1, wherein the plurality of tabs are two tabs.

18. The container of claim 1, wherein the plurality of tabs are four tabs.

19. The container of claim 1, wherein the preventing means permits the indicating means to move axially and rotationally on the cap until the desired indicia is selected.

20. The container of claim 1, wherein the plurality of indicia is located proximal to the one end of the first cap portion.

21. A container for cosmetics comprising:

a hollow body for containing cosmetics therein;

a cap removably secured at one end to the body, the cap having a first, a second and a third cap portion, the first cap portion being positioned adjacent the one end and having a plurality of indicia, the second cap portion being positioned adjacent the first cap portion and having a plurality of embossments with each embossment aligned with a different one of the plurality of indicia, the second cap portion also having a plurality of tabs, the third cap portion being positioned adjacent the second cap portion and opposite the first cap portion; and means, adapted to be mounted onto the said cap and adapted to be moved to a desired location, for indicating a desired one of the plurality of indicia to be viewed, the indicating means having an operative position at which one indicia can be viewed and an inoperative position in which the indicia cannot be viewed, the indicating means having a first, a second and a third circumferential surface portion, the first surface portion being sized to fit about the first cap portion and having a hole through which the indicia can be viewed ,the second and the third surface portions being sized to fit about the second surface portion, the second cap portion having an inside surface with a plurality of grooves therein, wherein each groove is adapted to engage a different one of the plurality of embossments of the second cap portion to prevent rotational movement between the cap and the indicating means when the desire done of the plurality of indicia is selected, and wherein the inside surface is adapted to fictionally engage the plurality of tabs of the second cap portion when the hole is positioned over the desired one of the plurality of indicia to further prevent rotational movement between the cap and the indicating means and thereby maintaining the indicating means in a fixed position on the cap for viewing of the selected desired indicia; and means, positioned on the second surface portion, for preventing removal of the indicating means from the cap.

22. The container of claim 21, wherein the second cap portion has a plurality of edge tabs, and wherein the preventing means includes the plurality of edge tabs and the inside surface of the second surface portion has an inside edge that is adapted to engage the plurality of edge tabs of the second cap portion to prevent removal of the indicating means from the cap.

23. The container of claim 21, wherein the indicating means is adapted to slide on and rotate about the cap when the indicating means is in an inoperative position.

* * * * *